US011554353B2

(12) United States Patent
Maniere

(10) Patent No.: US 11,554,353 B2
(45) Date of Patent: Jan. 17, 2023

(54) APPARATUS, SYSTEM AND METHOD FOR EMULSIFYING OIL AND WATER

(75) Inventor: Olivier Maniere, Saint Thibault des Vignes (FR)

(73) Assignee: Solenis Technologies, L.P., Wilmington, DE (US)

( * ) Notice: Subject to any disclaimer, the term of this patent is extended or adjusted under 35 U.S.C. 154(b) by 918 days.

(21) Appl. No.: 13/382,177

(22) PCT Filed: Aug. 4, 2009

(86) PCT No.: PCT/FR2009/000976

§ 371 (c)(1),
(2), (4) Date: Jan. 4, 2012

(87) PCT Pub. No.: WO2011/015715

PCT Pub. Date: Feb. 10, 2011

(65) Prior Publication Data

US 2012/0103546 A1 May 3, 2012

(51) Int. Cl.

| | |
|---|---|
| ***B01F 25/312*** | (2022.01) |
| ***D21H 21/16*** | (2006.01) |
| ***B01F 23/41*** | (2022.01) |
| *D21H 17/17* | (2006.01) |
| *D21H 17/16* | (2006.01) |

(52) U.S. Cl.

CPC ..... *B01F 25/312* (2022.01); *B01F 23/41* (2022.01); *B01F 25/31243* (2022.01); *D21H 21/16* (2013.01); *D21H 17/16* (2013.01); *D21H 17/17* (2013.01)

(58) Field of Classification Search

CPC ..... B01F 5/0413; B01F 5/0428; B01F 5/043; B01F 25/312; B01F 25/31242; B01F 25/31243

USPC ..... 366/163.2; 137/888

See application file for complete search history.

(56) References Cited

U.S. PATENT DOCUMENTS

| | | | | |
|---|---|---|---|---|
| 1,540,592 A | | 6/1925 | Bertram | |
| 2,961,366 A | | 11/1960 | Weisgerber | |
| 4,026,817 A | * | 5/1977 | Ciuti | B01F 5/0473 366/163.2 |

(Continued)

FOREIGN PATENT DOCUMENTS

| | | | |
|---|---|---|---|
| EP | 0629741 A1 | | 12/1994 |
| GB | 2016940 | * | 10/1979 |

(Continued)

OTHER PUBLICATIONS

Jenkins, Stan, "Recent Developments and Trends in ASA Sizing", Papertex Ltd., (2007), pp. 1-11.

*Primary Examiner* — Marc C Howell

(74) *Attorney, Agent, or Firm* — Lorenz & Kopf, LLP

(57) ABSTRACT

An apparatus, system and method for emulsifying oil and water, such as for emulsifying a sizing agent for use in treating paper or paperboard, introduces a continuous phase under pressure through a continuous phase nozzle of a venturi apparatus and into a mixing section. A dispersed phase is introduced optionally under pressure into the mixing section of the venturi apparatus. The emulsion formed in the mixing section is directed through a mixed phase nozzle and out of the venturi apparatus. The mixed phase nozzle diameter of the venturi apparatus is larger than the continuous phase nozzle diameter at a ratio of greater than 1:1 and less than 4:1.

18 Claims, 2 Drawing Sheets

(56) References Cited

U.S. PATENT DOCUMENTS 4,040,900 A 8/1977 Mazzarella et al.
4,210,534 A * 7/1980 Molvar ..... B01F 3/0446 210/220
4,234,481 A 11/1980 Steiner
4,240,935 A 12/1980 Dumas
4,279,794 A 7/1981 Dumas
4,295,931 A 10/1981 Dumas
4,317,756 A 3/1982 Dumas
4,430,251 A 2/1984 Patterson et al.
4,522,686 A 6/1985 Dumas
5,171,795 A 12/1992 Miller et al.
5,403,522 A * 4/1995 Von Berg ..... 261/36.1
5,470,742 A 11/1995 Bull et al.
5,475,084 A * 12/1995 Okamoto et al. ..... 528/502 E
5,614,597 A 3/1997 Bower
5,658,378 A * 8/1997 Tsai et al. ..... 106/207.2
5,685,815 A 11/1997 Bottorff et al.
5,714,552 A 2/1998 Bower
5,725,731 A 3/1998 Brungardt et al.
5,766,417 A 6/1998 Brungardt
5,846,663 A 12/1998 Brungardt et al.
5,853,542 A 12/1998 Bottorff
5,863,128 A * 1/1999 Mazzei ..... B01F 5/0415 137/888
5,879,814 A 3/1999 Bottorff
5,931,771 A 8/1999 Kozyuk
5,989,446 A * 11/1999 Hicks ..... A62D 1/0042 106/18.11
6,210,475 B1 * 4/2001 Dauplaise et al. ..... 106/209.1
6,444,024 B1 9/2002 Mills et al.
7,270,727 B2 9/2007 Varnell
7,784,999 B1 * 8/2010 Lott ..... 366/163.2
2003/0205167 A1 * 11/2003 Dilts et al. ..... 106/219
2005/0058020 A1 * 3/2005 Lott ..... B01F 3/12 366/348
2008/0267006 A1 * 10/2008 Moreira Campos .. B01F 3/0446 366/165.1
2008/0277084 A1 11/2008 Denowski et al.

FOREIGN PATENT DOCUMENTS

WO WO-1998045034 A1 10/1998
WO WO-2001044575 A1 6/2001
WO WO-2001088262 A2 11/2001
WO WO-2006096216 A1 9/2006

* cited by examiner

10
PUMP
22
FLOW METER
20
CONTROL VALVE
18
FILTER
16
14
HOLDING TANK
12
PRESSURE GAUGE
40b
50 VENTURI APPARATUS
70
PRESSURE GAUGE
40c
PRESSURE CONTROL VALVE
74
HOLDING TANK
76
BACK PRESSURE REGULATOR
42
PRESSURE GAUGE
40a
FLOW METER
39
PUMP
38
FILTER
36
34
HOLDING TANK
32

APPARATUS, SYSTEM AND METHOD FOR EMULSIFYING OIL AND WATER

CROSS-REFERENCE TO RELATED APPLICATION

This application is a national stage application (under 35 U.S.C. 371) of PCT/FR2009/000976, filed Aug. 4, 2009.

FIELD OF THE INVENTION

The present invention relates to an apparatus, system and method for emulsifying oil and water that are especially useful for preparing aqueous emulsions of sizing agents for internal sizing or surface sizing of paper and paperboard or for inversion of inverse emulsion polymer products used for treating paper and paperboard.

BACKGROUND OF THE INVENTION

Additives used in the paper industry to impart resistance to aqueous penetrants are commonly referred to as sizing agents. The two most common synthetic sizing agents are alkyl ketene dimer (AKD) and alkenyl succinic anhydride (ASA).

AKD and ASA are hydrophobic, water-insoluble materials. These materials can be added to the pulp slurry before the sheet is formed, known as internal sizing, or can be applied to the surface of the formed web, known as surface sizing. For either application, the sizing agent should be well distributed in the aqueous system to be effective. For this reason, these water insoluble additives are commonly added in the form of aqueous, oil-in-water, emulsions.

The aqueous emulsions of sizing agents can be supplied to the paper mill in that form, or can be prepared on site. In fact, it is advantageous for some of the synthetic, cellulose reactive sizing agents to be emulsified on site. ASA, for example, is emulsified on site due to the instability of the anhydride functionality after emulsification with water.

At present, two classes of in-mill emulsification technology are used in the industry: (1) high shear, and (2) low shear. High shear emulsification entails passing ASA (or other sizing agent) and a protective colloid, starch or synthetic polymer, through a high shear turbine pump or homogenizer, with or without added surfactants. The limitations of this approach are the need for "relatively complex, expensive and heavy equipment capable of exerting high homogenizing shear and/or pressures, together with rigid procedures regarding emulsifying proportions, temperatures, etc., for producing a satisfactory stable emulsion of the particular size." (U.S. Pat. No. 4,040,900).

To address the limitations of high shear emulsification, low shear emulsification approaches have been proposed, starting with Mazzarella (U.S. Pat. No. 4,040,900) in 1977 who disclosed mixtures of ASA with 3-20 parts by weight of a surface active additive (surfactant) that were "easily emulsifiable with water in the absence of high shearing forces and under normal pressure by merely stirring, passing through a mixing valve or common aspirator." Unfortunately, such low shear emulsification can result in foam problems and poor sizing efficiency because the increased surfactant level causes surfactant to build up in the system. (C. E. Farley and R. B. Wasser, "Sizing with Alkenyl Succinic Anhydride", Chapter 3 in The Sizing of Paper, 2nd Edition, W. F. Reynolds, Ed., Tappi Press, 1989, pp 51-62).

More recently Pawlowska, et al. (WO2006/096216), disclose "an improved method of sizing paper at the wet end that will use simpler and less expensive, low shear equipment for the ASA emulsification." Pawlowska, et al. disclose a method for sizing comprising "forming, in the absence of high shearing forces, an aqueous sizing emulsion comprising an alkenyl succinic anhydride component" which is post-diluted with a cationic component. The primary difference between Pawlowska and Mazzarella is the post-dilution of the emulsion with a cationic component to enhance retention. The examples consistently demonstrate that the low shear ASA emulsions post-diluted with cationic starch are less effective sizing agents than high shear ASA emulsions, but it is argued that the simplicity of the emulsification process of the low shear ASA emulsions gives the paper maker "operational and cost benefits".

Other patents disclose use of modified starches (e.g., U.S. Pat. No. 6,210,475) or polymers (e.g., U.S. Pat. No. 6,444,024 B1), to enhance the performance of the low shear emulsification systems, but none solve the basic performance and runnability issues characteristic of the low shear system.

The definitions of "low shear" conditions versus "high shear" conditions in the literature on ASA emulsification tend to be qualitative. Typically, a list of equipment that does or does not fit the descriptor is used. "High shear" systems are: "present in Waring blenders, turbine pumps, or other extremely high speed agitators, etc.", and "are found in piston or other types of homogenization equipment" (Mazzarella). "Low shear" systems are: "merely stirring, passing through a mixing valve or common aspirator or by the usual agitation present in a stock preparation system" (Mazzarella) or, the shearing conditions "created by a device selected from the group of centrifugal pumps, static in-line mixers, peristaltic pumps, and combinations thereof" (Pawlowska). But these definitions get confused in lists of commercial emulsification equipment that include industrial low and high pressure units such as "Cytec low pressure turbine emulsifiers supplied by Cytec Industries, Inc., Nalco high pressure emulsifier systems, and National Starch turbine and venturi emulsifiers" suggesting that there are turbine pumps that fit within the low shear category. Additionally, Waring blenders are used to produce both low and high energy ASA emulsions (Chen and Woodward, Tappi J. August, 1986, pg 95) by varying the electrical voltage. So "low shear" and "high shear" systems cannot be defined simply by equipment type.

In "Principles of ASA Sizing" (CE Farley, 1987 Tappi Sizing Short Course, pg 89) there is a more quantitative definition of "high shear" and "low shear" emulsification systems: "High shear emulsification is done with a close tolerance turbine pump. The work done by the pump is such that the pressure differential between the pump outlet and inlet is about 120 to 140 psi (8.3 to 9.7 bar). ASA and starch are mixed at or near the inlet of the turbine pump." "In low shear emulsification, ASA, starch and a surfactant are mixed and passed through a series of venturis. Typical ratio of starch:ASA:surfactant is about 2.5:1:0.05. A potential disadvantage of this method is the higher level of surfactant used, which may cause "desizing" and poor ASA efficiency and foam problems." So, the distinction that Farley makes between high and low shear is that high shear systems have a pressure differential of about 120 to 140 psi (8.3 to 9.7 bar).

Similarly, Denowski et al. (US2008/0277084 A1) define low shear to be the ability to pump a liquid through a pump with a back pressure of 50 psi (3.4 bar) or less, whereas high shear is defined to require a back pressure of 150 to 300 psi (10.3 to 20.7 bar) to pump a liquid.

The need still exists in the marketplace for simpler, less expensive equipment for ASA emulsification that does not suffer from paper machine runnability issues (foam, deposits) and/or poor sizing efficiency due to high surfactant loading or poor emulsion quality.

SUMMARY OF THE INVENTION

It has been discovered that it is possible to prepare good quality, stable emulsions of sizing agents (such as ASA) in water, with good paper machine runnability and good sizing efficiency by feeding water through a venturi apparatus at relatively high pressure and introducing the sizing agent at the venturi suction inlet. This system is simpler, more reliable, more energy efficient and less expensive than the traditional high shear systems in use today, and provides better quality emulsions using lower surfactant levels than the low shear, low energy systems that are available currently. Furthermore, this system can be used for the in-mill emulsification of other papermaking additives, or the inversion of inverse emulsion polymer products.

In a first aspect, a system for emulsifying oil in water or water in oil includes a venturi apparatus. A continuous phase is introduced under pressure into the venturi apparatus and through a continuous phase nozzle of a first diameter into a mixing section. A dispersed phase is introduced into the mixing section of the venturi apparatus to form an emulsion of the dispersed phase in the continuous phase. The emulsion is directed through a mixed phase nozzle having a second diameter and toward an outlet of the venturi apparatus. The mixed phase nozzle diameter is larger than the continuous phase nozzle diameter at a ratio of greater than 1:1 and less than 4:1.

Preferably, the continuous phase comprises water, which is introduced at a pressure of from about 10 bar to about 50 bar, and the flow velocity is in the range of about 10 to 100 m/s. Preferably, the dispersed phase comprises one or more sizing agents. The emulsion may be discharged into a discharge chamber, where optional additives may be mixed therein. The emulsion may be stored for later use, or the emulsion may be diluted with water or other aqueous solution before added to the wet end, or to a size press or coater for a paper or paperboard making system. Alternatively, the emulsion may be added directly to the wet end, or to a size press or coater for a paper or paperboard making system.

The dispersed phase may contain one or a mixture of cellulose reactive paper sizing compounds or cellulose non-reactive paper sizing compounds. Exemplary cellulose-reactive paper sizing compounds include alkenyl succinic anhydride (ASA), ketene dimers and multimers, such as alkyl ketene dimer (AKD), organic epoxides containing from about 12 to 22 carbon atoms, acyl halides containing from about 12 to 22 carbon atoms, fatty acid anhydrides from fatty acids containing from about 12 to 22 carbon atoms and organic isocyanates containing from about 12 to 22 carbon atoms.

The dispersed phase may be introduced solely by suction at the suction inlet to the venturi apparatus, or optionally may be pumped with a pump into the mixing section. Preferably, the dispersed phase is filtered before it is introduced into the mixing section.

Alternatively, the continuous phase may be water and the dispersed phase may be an inverse emulsion polymer commonly used in papermaking. In this case, a water-in-oil emulsion containing polymer in the aqueous phase could be introduced into the venturi apparatus through the suction inlet. The presence of a large volume of dilution water and the mixing in the mixing section that breaks the emulsion will "activate" the polymer, producing a dilute polymer mixture containing oil droplets. One example of an inverse emulsion polymer commonly used in papermaking is a retention and drainage aid, such as PERFORM SP7200 or PERFORM PC8179 Retention and Drainage Aids (Ashland Inc., Covington, Ky.).

In a second aspect, a method for emulsifying a sizing agent for use in treating paper or paperboard has the following steps. A continuous phase is introduced under pressure into a venturi apparatus and to a continuous phase nozzle having a first diameter that directs said continuous phase into a mixing section of the apparatus. A dispersed phase is introduced into the mixing section of the venturi apparatus to form an emulsion of the dispersed phase in the continuous phase. The emulsion is directed through a mixed phase nozzle having a second diameter d2 that is larger than the continuous phase nozzle diameter d1 at a ratio of greater than 1:1 and less than 4:1. Preferably, the continuous phase is introduced at a pressure of from about 10 bar to about 50 bar and has a flow velocity in the continuous phase nozzle of from about 10 to 100 m/s.

In the method, the dispersed phase may contain one or a mixture of cellulose reactive paper sizing compounds or cellulose non-reactive paper sizing compounds. Exemplary cellulose reactive paper sizing compounds include alkenyl succinic anhydride (ASA), ketene dimers and multimers, organic epoxides containing from about 12 to 22 carbon atoms, acyl halides containing from about 12 to 22 carbon atoms, fatty acid anhydrides from fatty acids containing from about 12 to 22 carbon atoms and organic isocyanates containing from about 12 to 22 carbon atoms.

In the method, the dispersed phase may be introduced solely by suction at the suction inlet to the venturi apparatus, or optionally may be pumped with a pump into the mixing section. Preferably, the dispersed phase is filtered before it is introduced into the mixing section.

The resulting emulsion of sizing agent has a mean particle size below about 2 microns, preferably between 0.5 and 1.5 micron, most preferably below about 1 micron, as measured by light scattering technique on a sample emulsion within about one to about ten minutes after the emulsion exits the venturi apparatus. The emulsion is added either to a wet end or to a size press or coater for a paper or paperboard making system. If the continuous phase is water, the emulsion preferably is post-diluted with water to produce a solids content in a range of about 1 to about 5 wt. %. Then, the post-diluted emulsion preferably is mixed with an aqueous solution of a natural or synthetic cationic polymer before it is added to the wet end, size press or coater.

In another aspect, a venturi apparatus has a continuous phase nozzle of a first diameter that directs a first liquid under pressure to a mixing section, and an inlet for directing a second liquid to the mixing section to form an emulsion therein. The venturi apparatus further has a mixed phase nozzle having a second diameter through which the emulsion is directed toward an outlet from the venturi apparatus. The mixed phase nozzle diameter is larger than the continuous phase nozzle diameter at a ratio of greater than 1:1 and less than 4:1. Preferably, the mixing section is conical and tapers from a widest diameter where the inlet meets the mixing section to a narrowest diameter where the mixed phase nozzle meets the mixing section. Preferably, the venturi apparatus includes a discharge diffuser in fluid communication with the mixed phase nozzle and at the outlet of the venturi apparatus.

BRIEF DESCRIPTION OF THE DRAWINGS

Other goals, advantageous features, and possible applications of the present invention are disclosed in the following description of the embodiments with reference to the following drawings, in which.

DETAILED DESCRIPTION OF THE INVENTION

In this application, an "emulsion" is a mixture of particles of one liquid in a second liquid. Two common types of emulsions are oil-in-water and water-in-oil. "Oil" is intended generally to denote a water-insoluble or nearly water-insoluble liquid. For oil-in-water emulsions water is the "continuous phase" and oil is the discontinuous phase. For water-in-oil emulsions, it is the opposite. The liquid that forms the continuous phase of the final emulsion is referred to herein as the "continuous phase" and the other liquid that forms the discontinuous phase of the final emulsion is referred to as the "dispersed phase". In the case of an oil-in-water emulsion, water is the continuous phase and oil is the dispersed phase.

Figure 1:
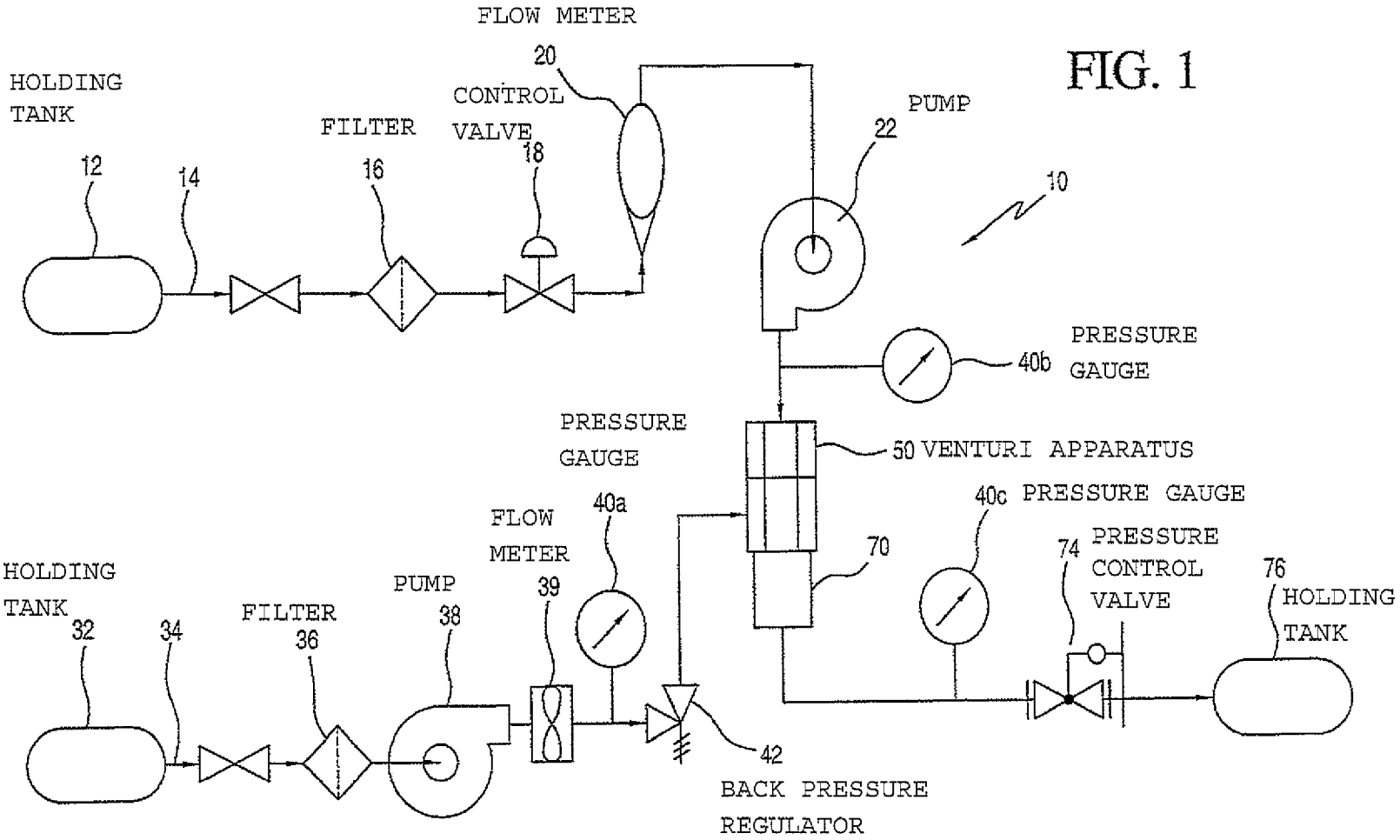
FIG. 1 is a schematic diagram of an exemplary system for emulsifying oil and water according to the invention.

A schematic of a system 10 for emulsifying oil and water is shown in FIG. 1. The system 10 will be described with reference to emulsifying a sizing agent, such as alkyl ketene dimer (AKD) or alkenyl succinic anhydride (ASA), in water. However, it is understood that the system may be used to emulsify other materials, and the choice of continuous and dispersed phases is for illustration purposes and is not meant to limit the invention.

Referring to FIG. 1, a supply of a "continuous phase", such as but not limited to water in this embodiment, from a holding tank or supply reservoir 12 is fed through line 14 and filter 16 through a control valve 18 and a flow meter 20 to a pump 22. The flow rate of the water, which may alternatively be referred to as "continuous phase" with respect to this embodiment, is controlled at a specific feed rate using a control loop with the flow meter 20 and control valve 18. Other means of flow control are possible as would be available to one skilled in the art. The pump 22 can be any of a number of type of pumps, including a multi-stage centrifugal pump or a regenerative pump, that can deliver a feed pressure of about 30 bar, or feed pressures in the range of about 10 bar to 50 bar, more preferably about 18 to 35 bar. Pressure gauges 40*b*, 40*a*, 40*c* are provided to monitor pressures of the continuous phase, dispersed phase and emulsion, respectively. The continuous phase is delivered to a first inlet 48 (see FIG. 3) of a venturi apparatus 50.

Figure 2:
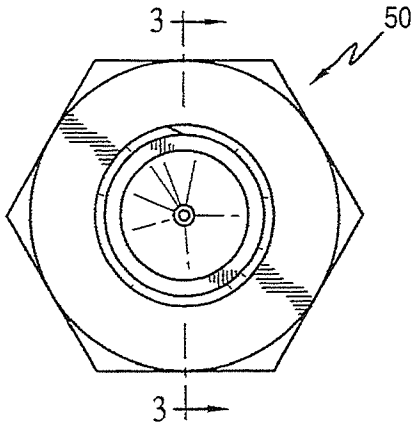
FIG. 2 is an outlet end elevational view of a venturi apparatus according to the invention.
Figure 3:
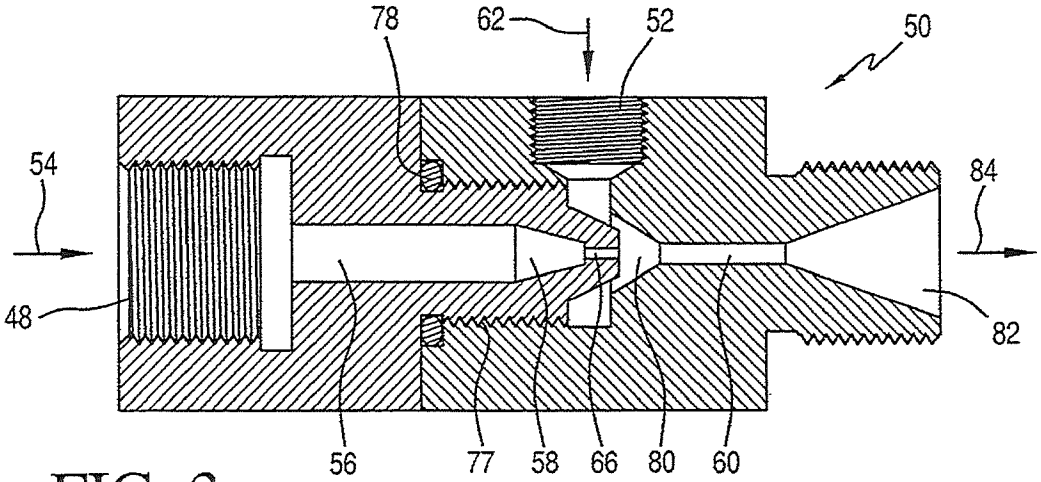
FIG. 3 is a cross-sectional view of the venturi apparatus taken along line 3-3 of FIG. 2.
Figure 4:
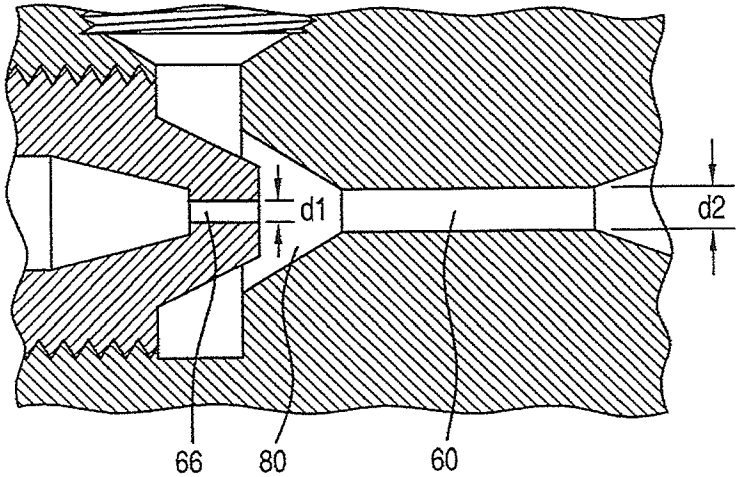
FIG. 4 is an exploded cross-sectional view of the venturi apparatus showing continuous phase nozzle and mixed phase nozzle of the venturi apparatus of FIG. 3.

A "dispersed phase", such as but not limited to liquid sizing agent in this embodiment, from a holding tank or supply reservoir 32 is fed (or pumped by optional pump 38) through line 34 and filter 36 through flow meter 39 and back pressure regulator 42 to a suction inlet 52 (see FIG. 3) of venturi apparatus 50. Filter 36 is sized to avoid plugging of a mixed phase nozzle 60 of the venturi apparatus 50. Refer to FIGS. 2-4 for details of venturi apparatus 50.

Optional pump 38 can be any of a number of types of pumps that can deliver a feed pressure of up to about 5 bar, preferably for example about 3 bar. The flow rate of the sizing agent, which may also be referred to as the "dispersed phase" in this embodiment, can be controlled with the pump 38 or with a control loop. It is also possible to provide alternative controls to set the ratio of continuous phase to dispersed phase fed to the venturi apparatus 50. Since the continuous phase fed to the venturi apparatus 50 produces a vacuum at the dispersed phase suction inlet 52, pump 38 is not necessary to feed the dispersed phase to the venturi apparatus 50. Nevertheless, using pump 38 to feed the dispersed phase to the venturi apparatus 50 results in a more consistent feed pressure and provides better control in the emulsion forming process.

Continuous and dispersed phases mix in the venturi apparatus 50 and are discharged to chamber 70. Chamber 70 is of sufficient diameter to reduce velocity of emulsified product from the venturi apparatus 50. Additives can be mixed with emulsified product in chamber 70 or downstream of chamber 70.

Mixed phase or emulsified product may be directed to the paper machine or may be directed through pressure control valve 74 to a holding tank 76 or shipping container (not shown). If the continuous phase is water, the emulsion preferably is post-diluted with water to produce a solids content in a range of about 1 to about 5 wt. %. Then, the post-diluted emulsion preferably is mixed with an aqueous solution of a natural or synthetic cationic polymer before it is added to the wet end, size press or coater of a paper or board machine.

One embodiment of a venturi apparatus 50 for emulsifying oil and water is shown in FIGS. 2 to 4. FIG. 3 is a longitudinal section of the venturi apparatus 50. The venturi apparatus 50 has a first inlet 48 into which the continuous phase, such as water, is introduced. The continuous phase flows through the venturi apparatus 50 in the direction of arrow 54. Continuous phase flow velocity is increased going from first inlet 48 into a smaller diameter channel 56 and into a conical section 58 before entering smallest diameter nozzle or continuous phase nozzle 66. Shape and dimensions of the continuous phase flow channel can be varied.

The venturi apparatus 50 has a suction inlet 52 through which the dispersed phase, such as but not limited to sizing agent, enters the venturi apparatus 50 in the direction of arrow 62. Vacuum is produced at the suction inlet 52 by flow of the continuous phase through continuous phase nozzle 66.

The continuous phase (e.g., water) and the dispersed phase (e.g., sizing agent) mix in generally conical chamber 80 and enter mixed phase nozzle 60. In the invention, the mixed phase nozzle diameter d2 is larger than the continuous phase nozzle diameter d1 at a ratio of greater than 1:1 and less than 4:1. In one embodiment of the invention, referring to FIG. 4, mixed phase nozzle 60 has a diameter d2 that is two times the diameter d1 of continuous phase nozzle 66. The continuous phase and dispersed phase mix by turbulence within conical mixing chamber 80 between continuous phase nozzle 66 and mixed phase nozzle 60 to form the emulsion or mixed phase. The emulsion exits mixed phase nozzle 60 through a discharge diffuser 82 and exits the venturi apparatus in the direction of arrow 84. The emulsion so formed is discharged into chamber 70 (see FIG. 1).

Emulsions are formed in this invention by feeding the continuous phase of an emulsion through the continuous phase nozzle 66 at high pressure. Flow of the continuous phase through the continuous phase nozzle 66 creates an area of low pressure at the dispersed phase inlet 52 to the venturi apparatus 50. The continuous and dispersed phases are mixed in a generally conical mixing chamber 80 inside the venturi apparatus 50 and fed to a mixed phase nozzle 60 that has a diameter d2 larger than the diameter d1 of the continuous phase nozzle 66. The two different diameter sizes d2, d1 create two jet layers at high velocity. Emulsified product from the venturi apparatus 50 is discharged into a chamber 70 where pressure and fluid velocity are reduced. In the chamber 70 or downstream from the chamber 70, additional agents may be added to the emulsion to enhance emulsion performance, or the emulsion may be diluted with water and/or aqueous cationic polymer solution, or other emulsion modifications are possible. FIG. 1 further shows optional tank 76 into which the emulsion may be deposited.

One representative venturi apparatus 50 has the following dimensions. Referring to FIG. 4, the mixed phase nozzle 60 has a circular diameter d2 of about 1.2 mm and the continuous phase nozzle 66 has a circular diameter d1 of about 0.7 mm. In an alternative apparatus, the mixed phase nozzle 60 has a circular diameter d2 of about 1.8 mm and the continuous phase nozzle 66 has a circular diameter d1 of about 1 mm. Referring to FIG. 43, the representative venturi apparatus 50 has an overall length of about 90 mm. First inlet 48 is formed to have approximately a 12.7 mm (0.5 inch) threaded female circular opening to receive a feeder tube or pipe fitting (not shown) for the continuous phase to be introduced into the first inlet 48. The first inlet 48 has a length of about 20 mm, and the smaller diameter channel 56 has a length of about 35 mm, with the distal end forming a conical taper to direct the continuous phase liquid into continuous phase nozzle 66. Continuous phase nozzle 66 has a length of approximately 4 mm. Mixed phase nozzle 60 has a length of approximately 15 mm.

The suction inlet 52 in the representative venturi apparatus 50 has a circular diameter of approximately 10 mm and a length of approximately 10 mm. The suction inlet 52 tapers to a conical distal end that directs the dispersed phase material to tubing that leads to conical chamber 80 for mixing the continuous phase and dispersed phase together to form an emulsion or mixed phase. The conical chamber 80 has a circular proximal diameter of about 10 mm and tapers toward the mixed phase nozzle 60 at its distal end.

The discharge diffuser 82 at the distal end of the representative venturi apparatus 50 according to the invention is formed to have approximately a 12.7 mm (0.5 inch) externally threaded exterior to be joined to a threaded discharge tube or pipe fitting (not shown) for the mixed phase (emulsion) to exit from the venturi apparatus 50. The discharge diffuser has a length of approximately 18 mm, and an external circular opening with a diameter of about 15 mm. An end elevational view of the venturi apparatus 50 from the discharge diffuser 82 in FIG. 2 shows that the venturi apparatus 50 has a generally hexagonal or six-sided exterior, and the height and width of such exterior is approximately 36 mm.

The representative venturi apparatus 50 is shown in FIG. 3 formed of two machined parts, with the first part in which is formed the first inlet 48 leading to the venturi nozzle 66, and the second part in which is formed the suction inlet 52, the conical chamber 80, the mixed phase nozzle 60 and the diffuser 82. The first part engages the second part and is threadably connected by threads 77 formed on the exterior of first part and interior of second part. A sealing ring 78 is provided for fluid-tight sealing of the first part and second part.

The continuous phase of the emulsion can be water-based or oil-based. When the continuous phase is water-based, the dispersed phase of emulsion can be oil-based. When the continuous phase is oil-based, the dispersed phase of the emulsion can be water-based. Examples of continuous water-based phases include, but are not limited to, water, aqueous starch solutions and polymer solutions. Additional ingredients commonly used in emulsions of sizing agents, such as but not limited to, biocides, alum, cationic resins, surfactants, etc., may be included in the continuous phase feed. Examples of dispersed oil phase include, but are not limited to, ASA, AKD, and polymers. Additives such as surfactants optionally can be included in the oil phase.

Continuous phase feed pressure is between about 10 bar and 50 bar, preferably between about 18 bar and 35 bar. The ratio of mixed phase nozzle size to continuous phase nozzle size is greater than 1:1 and less than 4:1, preferably between 1.5:1 and 2.5:1. The diameter of continuous phase nozzle (e.g., nozzle 66 in FIG. 3) is set to obtain a flow velocity of about 10 to 100 m/s, preferably, about 40 to 60 m/s. High velocity creates conditions that form emulsions instantaneously.

The ratio of continuous phase to dispersed phase is varied to meet emulsion requirements for viscosity, stability, and homogeneity. Concentration of dispersed phase in continuous phase varies from about 2 to 50 weight %, preferably, about 4 to 35 weight %. The diameter of the chamber at the discharge of the venturi apparatus (e.g., chamber 70 in FIG. 1) is about 5 to 100 times the diameter of the continuous phase venturi apparatus nozzle (e.g., nozzle 66 in FIG. 23), preferably about 40 to 80 times the diameter of the continuous phase nozzle 66. Pressure in the chamber (e.g., chamber 70 in FIG. 1) is about 1 to 6.7 bar, preferably about 1.3 to 5 bar. Dispersed phase feed pressure is about 1.3 to 6.7 bar, preferably about 3 to 4.3 bar.

Preferred paper sizing compounds for the dispersed phase of the invention are selected from the group consisting of cellulose reactive paper sizing compounds and cellulose non-reactive paper sizing compounds. For the purposes of this invention cellulose-reactive sizes are defined as those sizes capable of forming covalent chemical bonds by reaction with the hydroxyl groups of cellulose, and cellulose non-reactive sizes are defined as those that do not form these covalent bonds with cellulose.

Preferred cellulose-reactive sizes for use in the invention include alkenyl succinic anhydrides (ASA), ketene dimers and multimers, organic epoxides containing from about 12 to 22 carbon atoms, acyl halides containing from about 12 to 22 carbon atoms, fatty acid anhydrides from fatty acids containing from about 12 to 22 carbon atoms and organic isocyanates containing from about 12 to 22 carbon atoms. Mixtures of reactive sizing agents may also be used.

Alkenyl succinic anhydrides (ASA) are composed of unsaturated hydrocarbon chains containing pendant succinic anhydride groups. They are usually made in a two-step process starting with an alpha olefin. The olefin is first isomerized by randomly moving the double bond from the alpha position. In the second step the isomerized olefin is reacted with maleic anhydride to give the final ASA of generalized formula (1) (see below). Typical olefins used for the reaction with maleic anhydride include alkenyl, cycloalkenyl and aralkenyl compounds containing from about 8 to about 22 carbon atoms. Specific examples are isooctadecenyl succinic anhydride, n-octadecenyl succinic anhydride, n-hexadecenyl succinic anhydride, n-dodecyl succinic anhydride, i-dodecenyl succinic anhydride, n-decenyl succinic anhydride and n-octenyl succinic anhydride.

(1)

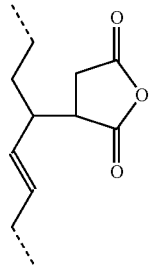

Alkenyl succinic anhydrides are disclosed in U.S. Pat. No. 4,040,900, which is incorporated herein by reference in its entirety, and by C. E. Farley and R. B. Wasser in The Sizing of Paper, Second Edition, edited by W. F. Reynolds, Tappi Press, 1989, pages 51-62. A variety of alkenyl succinic anhydrides are commercially available from Bercen, Inc., Denham Springs, La. Alkenyl succinic anhydrides for use in the invention are preferably liquid at 25° C. More preferably they are liquid at 20° C.

Preferred ketene dimers and multimers are materials of formula (2) (see below), wherein n is an integer of 0 to about 20, R and R", which may be the same or different, are saturated or unsaturated straight chain or branched alkyl or alkenyl groups having 6 to 24 carbon atoms; and R' is a saturated or unsaturated straight chain or branched alkylene group having from about 2 to about 40 carbon atoms.

(2)

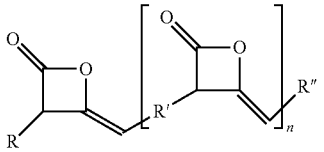

Ketene dimers for use as the dispersed phase in the process of this invention have the structure of formula (2) where n=0 and the R and R" groups, which can be the same or different, are hydrocarbon radicals. Preferably the R and R" groups are straight chain or branched alkyl or alkenyl groups having 6 to 24 carbon atoms, cycloalkyl groups having at least 6 carbon atoms, aryl groups having at least 6 carbon atoms, aralkyl groups having at least 7 carbon atoms, alkaryl groups having at least 7 carbon atoms, and mixtures thereof. More preferably, ketene dimer is selected from the group consisting of (a) octyl, decyl, dodecyl, tetradecyl, hexadecyl, octadecyl, eicosyl, docosyl, tetracosyl, phenyl, benzyl, .beta.-naphthyl, and cyclohexyl ketene dimers, and (b) ketene dimers prepared from organic acids selected from the group consisting of montanic acid, naphthenic acid, 9,10-decylenic acid, 9,10-dodecylenic acid, palmitoleic acid, oleic acid, ricinoleic acid, linoleic acid, eleostearic acid, naturally occurring mixtures of fatty acids found in coconut oil, babassu oil, palm kernel oil, palm oil, olive oil, peanut oil, rape oil, beef tallow, lard, whale blubber, and mixtures of any of the above named fatty acids with each other. Most preferably ketene dimer is selected from the group consisting of octyl, decyl, dodecyl, tetradecyl, hexadecyl, octadecyl, eicosyl, docosyl, tetracosyl, phenyl, benzyl, β-naphthyl, and cyclohexyl ketene dimers.

Alkyl ketene dimers have been used commercially for many years and are prepared by dimerization of the alkyl ketenes made from saturated, straight chain fatty acid chlorides; the most widely used are prepared from palmitic and/or stearic acid. Neat alkyl ketene dimer is available as AQUAPEL 364 sizing agent from Ashland Hercules Water Technologies, Ashland Inc, Wilmington, Del.

Preferred ketene multimers for use as the dispersed phase in the process of this invention have the formula (2) where n is an integer of at least 1, R and R", which may be the same or different, are saturated or unsaturated straight chain or branched alkyl or alkenyl groups having 6 to 24 carbon atoms, preferably 10 to 20 carbon atoms, and more preferably 14 to 16 carbon atoms, and R' is a saturated or unsaturated straight chain or branched alkylene group having from 2 to 40 carbon atoms, preferably from 4 to 8 or from 28 to 40 carbon atoms.

Preferred ketene multimers are described in: European Patent Application Publication No. 0 629 741 A1, and in U.S. Pat. Nos. 5,685,815 and 5,846,663, both of which are incorporated herein by reference in their entireties.

Among the preferred ketene dimers and multimers for use as the dispersed phase in the invention are those which are not solid at 25° C. (not substantially crystalline, semi-crystalline or waxy solid; i.e., they flow on heating without heat of fusion). Ketene dimers and multimers not solid at 25° C. are disclosed in U.S. Pat. Nos. 5,685,815, 5,846,663, 5,725,731, 5,766,417 and 5,879,814, all of which are incorporated herein by reference in their entireties. Ketene dimers not solid at 25° C. are available as PREQUEL and PRECIS sizing agents, from Ashland Hercules Water Technologies, Wilmington, Del.

Other preferred cellulose-reactive sizes for use as dispersed phase in the invention are mixtures of ketene dimers or multimers with alkenyl succinic anhydrides as described in U.S. Pat. No. 5,766,417, which is incorporated herein by reference in its entirety.

Cellulose non-reactive sizes for use as dispersed phase in the invention preferably include hydrophobic materials that are free flowing below a temperature of 95° C., preferably below 70° C., for example, wax, rosin esters, hydrocarbon or terpene resins and polymeric sizing agents.

The sizing emulsions of this invention also suitably may contain at least one surfactant to facilitate their emulsification in water; such materials are well known in this art. The surfactant component facilitates the emulsification of the sizing agent with water component when the emulsion is made. Generally, the surfactants are anionic or nonionic or can be cationic and can have a wide range of HLB values.

Suitable surfactants include but are not limited to phosphated ethoxylates which may contain alkyl, aryl, aralkyl or alkenyl hydrocarbon substituents, sulfonated products such as those obtained from sulfonating fatty alcohols or aromatic fatty alcohols, ethoxylated alkyl phenols such as nonyl phenoxy polyethoxy ethanols and octyl phenoxy polyethoxy ethanols, polyethylene glycols such as PEG 400 monooleate and PEG 600 dilaurate, ethoxylated phosphate esters, dialkyl sulfosuccinates such as sodium dioctyl sulfosuccinate, polyoxyalkylene alkyl or polyoxyalkylene alkylaryl ethers or corresponding mono- or di-esters, and trialkyl amines and their acid and quaternary salts as well as amine hydrates such as oleyl dimethylamine and stearyl dimethylamine.

Preferred surfactants are those which emulsify the sizing agent to give the smallest median emulsion droplet diameter or particle size. Such emulsions may have a median emulsion droplet diameter or particle size of about 2 microns or less, preferably between 0.5 and 1.5 microns, and most preferably about 1 micron or less. Droplet size may be conveniently measured by any number of well-known particle size measurement techniques, e.g., microscopy, classical and quasi-elastic light scattering, sedimentation, disc centrifugation, electrozone sensing, sedimentation field flow fractionation and chromatographic methods. Conveniently, droplet sizes may be estimated by a light scattering method using an instrument such as a HORIBA LA-300 particle size analyzer.

The quantity of surfactant may, of course, vary depending upon the particular surfactant or surfactant blend used, as is well known to those of ordinary skill in this art. The quantity of surfactant present in a sizing composition of the invention should not exceed the minimum required to achieve a median particle size of about 2 microns or less, preferably between 0.5 and 1.5 microns, and most preferably, about 1 micron or less in the resulting emulsion. Higher amounts can result in degradation of the particle size and the machine runnability issues that are a consequence of a low quality emulsion. From about 0.01% to about 10% of surfactant by weight based on the total weight of sizing agent present may be used. Preferably, the quantity of surfactant present in a sizing composition is from about 0.1% to about 5% by weight. Most preferably, the quantity of surfactant present in a sizing composition is less than about 1.0% by weight. Commercially available mixtures comprising at least one sizing agent and at least one surfactant, such as PREQUEL 20F or PREQUEL 90F sizing agents available from Ashland Inc., Wilmington, Del., may be conveniently used in forming the sizing emulsions of the invention.

For oil-in-water emulsions, such as emulsions of sizing agents, the continuous phase can be water or an aqueous solution of a natural or synthetic polymer. Water is preferred. If the continuous phase is water, post dilution of the emulsion with water to reach a desired solids content, followed by further dilution with an aqueous solution of a natural or synthetic polymer is recommended. Cationic polymers suitable for use in forming oil-in-water emulsions of sizing agents include any water-soluble nitrogen-containing cationic polymer that confers a positive surface charge to the particles of the dispersed phase of the emulsion. Such cationic polymers are typically quaternary ammonium compounds; homopolymers or copolymers of ethylenically unsaturated amines; the resinous reaction products of epihalohydrins and polyaminopolyamides, alkylenepolyamines, poly(diallylamines), bis-aminopropylpiperazine, dicyandiamide (or cyanamide)-polyalkylene polyamine condensates, dicyandiamide (or cyanamide)-formaldehyde condensates, and dicyandiamide (or cyanamide)-bis-aminopropylpiperazine condensates; and cationic starches. Cationic starches are water-soluble starches containing sufficient amino groups, quaternary ammonium or other cationic groups to render the starch, as a whole, cellulose substantive. Preferred is cationic starch. Non-cationic polymers also may be used.

The use of cationic polymers in sizing compositions is generally described in U.S. Pat. Nos. 4,240,935, 4,243,481, 4,279,794, 4,295,931, 4,317,756, 4,522,686, all to Dumas, in U.S. Pat. No. 2,961,366 to Weisgerber, and U.S. Pat. No. 5,853,542 (Bottorff). Amphoteric polymers, such as those disclosed in U.S. Pat. No. 7,270,727 (Varnell), can also be used. The entire content of each of these patents is hereby incorporated by reference.

The minimum amount of cationic polymer used should be sufficient to render the dispersion cationic. The amount used will vary depending on the water solubility and the cationic strength of the particular polymer employed, and other variables, such as water quality.

The amount of natural or synthetic polymer may be expressed as a percentage of the weight of cellulose-reactive size used. Preferably, the polymer is from about 0.1 to about 400 wt % of the weight of the cellulose-reactive size, more preferably from about 2 to about 100 wt % of the weight of the cellulose-reactive size, and most preferably from about 10 to about 30 wt % of the weight of the cellulose-reactive size. This amount will depend on the requirements for a specific paper production application.

The temperature of the aqueous solution used for post-dilution is generally less than about 50° C., but may be higher depending upon the application. The pH of the aqueous solution varies, depending on the application. The pH can range from about 4 to 8. Post-dilution is generally carried out under low shear conditions, for example those shearing conditions created by a device such as a centrifugal pump, static in-line mixer, peristaltic pump, overhead stirrer, or combinations thereof.

The sizing agent emulsions prepared by this invention may be used in internal sizing of paper or paperboard in which the sizing emulsions are added to the pulp slurry in the wet end of the paper making process, or surface sizing of paper or paperboard in which the sizing dispersions are applied at the size press or the coater. This invention may also be used in one or both parts of a two-part sizing system. For example, one part may be mixed internally with the wood pulp and a second part applied at the size press, a common practice in papermaking.

The amount of sizing agent either added to the stock or applied as a surface size is from about 0.005 to 5% by weight, based on the dry content of the stock, i.e., fibers and optional filler, and preferably from 0.01 to 1% by weight, where the dosage is mainly dependent on the quality of the pulp or paper to be sized, the sizing compound used and the level of sizing desired.

Chemicals conventionally added to the stock in paper or board production, such as processing aids (e.g., retention aids, drainage aids, contaminant control additives, etc.) or other functional additives (e.g., wet or dry strength additives, dyes, optical brightening agents, etc.) can be used in combination with the sizing agents of this invention.

The invention has been described heretofore with reference to a dispersed phase that may comprise a sizing agent. Alternatively, the venturi apparatus 50 of this invention can also be used to make-down inverse emulsion polymers commonly used in the papermaking process. Inverse emulsion polymers are prepared and stabilized using surface active agents, more commonly known as surfactants. The surfactants utilized will permit the emulsification of the water soluble monomer in the oil phase prior to polymerization, and provide stability to the resultant emulsion polymer. Stability, which includes resistance to settling, minimal changes in viscosity with time and premature inversion, not to mention the need for a stable emulsion during the polymerization process, requires a robust emulsion stabilization package.

Inversion of the emulsion refers to the process prior to use, where the phases are reversed, and the polymer is released from the discontinuous phase. A large volume of aqueous solution is added to create a continuous aqueous (water) phase where the coalescence of the previously dispersed aqueous phase results in the dispersal of the polymer in solution, resulting in a viscosification of the solution. Inversion is assisted by adding surfactants, termed "breaker surfactants", to the emulsion to help disrupt the original emulsion stabilization system when the relatively large volume of water is combined, using some level of agitation or shear, with the water-in-oil emulsion. It is the joint action of these three factors, the large volume of dispersed phase, the shear forces, and the breaker surfactant(s), that results in the inversion, or phase reversal, of the emulsion. Moreover, the polymer is now available to interact with other aqueous phase materials. The relative smaller amount of oil (20-40% by weight of the original emulsion) becomes dispersed in the water phase, where, due to the addition of the large volume of aqueous solution, the oil is a minor component.

The polymer is inverted into an aqueous solution, such that the resultant concentration of active polymer typically ranges from about 0.1% to about 1.5% by weight. The concentration utilized depends upon numerous factors, including but not limited to, the water chemistry and temperature, solution viscosity, feed rate, and equipment size and flow rates.

The emulsion polymer may be inverted into an aqueous solution by directing convergent flows of water and neat emulsion at the desired concentrations through the venturi apparatus 50. In the inversion, the continuous phase is water, which is introduced through the first inlet 48 of the venturi apparatus 50, and the dispersed phase is the emulsion polymer or neat emulsion, which is introduced through the suction inlet 52 of the venturi apparatus 50. The continuous phase pressure may be in the range of about 10 to 40 bar, preferably about 15 to 25 bar, and the continuous phase flow velocity may be about 10 to 50 m/s, preferably about 25 to 35 m/s. The resultant mixture is then passed through a mixing stage, such as a static mixer or mechanical pump, where the mixing action enhances the inversion process. The aqueous solution is then typically transferred into a tank, where it is mixed until homogenous. In a continuous system the step of transferring to a tank is eliminated.

Additional dilution water is typically added to the inverted polymer solution just prior to introduction into the process to aid in dispersal of the polymer.

EXAMPLES

Example 1

150 l/h water was fed as continuous phase into a first inlet of a venturi apparatus such as shown in FIGS. 2-4. Water feed pressure was 30 bar. The continuous phase nozzle diameter (e.g., diameter of nozzle 66 in FIG. 3) was 1 mm. PREQUEL 20F sizing agent (an ASA) dispersed phase was fed by vacuum to the suction inlet of the venturi apparatus at 15 kg/h. The mixed phase nozzle diameter (e.g., diameter of nozzle 60 in FIG. 3) was 2 mm. The venturi velocity was 53 m/s within the continuous phase nozzle. The emulsion had a median particle size of 0.67 microns.

Example 2

170 l/h water was fed as continuous phase into a first inlet of a venturi apparatus such as shown in FIGS. 2-4. Water feed pressure was 30 bar. The continuous phase nozzle diameter (e.g., diameter of nozzle 66 in FIG. 3) was 1 mm. PREQUEL 20F sizing agent (an ASA) dispersed phase was fed by vacuum to the suction inlet of the venturi apparatus at 27 kg/h. The mixed phase nozzle diameter (e.g., diameter of nozzle 60 in FIG. 3) was 2 mm. The venturi velocity was 60 m/s within the continuous phase nozzle. The emulsion had a median particle size of 0.67 microns.

Example 3

80 l/h water was fed as continuous phase into a first inlet of a venturi apparatus such as shown in FIGS. 2-4. Water feed pressure was 31 bar. The continuous phase nozzle diameter (e.g., diameter of nozzle 66 in FIG. 3) was 0.8 mm. PREQUEL 20F sizing agent (an ASA) dispersed phase was fed by vacuum to the suction inlet of the venturi apparatus at 8 kg/h. The mixed phase nozzle diameter (e.g., diameter of nozzle 60 in FIG. 3) was 1.6 mm. The venturi velocity was 44 m/s within the continuous phase nozzle. The emulsion had a median particle size of 0.82 microns.

Example 4

Comparison 180 l/h water was fed as continuous phase into a first inlet of a venturi apparatus such as shown in FIGS. 2-4. Water feed pressure was 32 bar. The continuous phase nozzle diameter (e.g., diameter of nozzle 66 in FIG. 3) was 1 mm. PREQUEL 20F sizing agent (an ASA) dispersed phase was fed by vacuum to the suction inlet of the venturi apparatus at 15 kg/h. The mixed phase nozzle diameter (e.g., diameter of nozzle 60 in FIG. 3) was 1 mm (same diameter for continuous phase nozzle and mixed phase nozzle). The venturi velocity was 63 m/s in the mixed phase nozzle. The emulsion was almost immediately dispersed in separate phases: water and ASA drops. The particle size distribution was impossible to measure.

Example 5

160 l/h water was fed as continuous phase into a first inlet of a venturi apparatus such as shown in FIGS. 2-4. Water feed pressure was 30 bar. The continuous phase nozzle diameter (e.g., diameter of nozzle 66 in FIG. 3) was 1 mm. PREQUEL 90F sizing agent (an AnKD available from Ashland Hercules Water Technologies, Wilmington, Del.) dispersed phase was fed by vacuum to the suction inlet of the venturi apparatus at 30 kg/h. The mixed phase nozzle diameter (e.g., the diameter of nozzle 60 in FIG. 3) was 2 mm. The venturi velocity was 5357 m/s within the continuous phase nozzle. The emulsion was stable with a median particle size of 0.8 microns.

Example 6

90 l/h water was fed as continuous phase into a first inlet of a venturi apparatus such as shown in FIGS. 2-4. Water feed pressure was 30 bar. The continuous phase nozzle diameter (e.g., diameter of nozzle 66 in FIG. 3) was 0.8 mm. Prequel 20F sizing agent (an ASA) dispersed phase was fed by vacuum to the suction inlet of the venturi apparatus at 30 kg/h. The mixed phase nozzle diameter (e.g., diameter of nozzle 60 in FIG. 3) was 2.4 mm. The venturi velocity was 4450 m/s within the continuous phase nozzle. The emulsion was stable with a median particle size of 1.15 microns.

Example 7

180 l/h water was fed as continuous phase into a first inlet of a venturi apparatus such as shown in FIGS. 2-4. Water feed pressure was 30 bar. The continuous phase nozzle diameter (e.g., diameter of nozzle 66 in FIG. 3) was 1.2 mm. Prequel 20F sizing agent (an ASA) dispersed phase was fed by vacuum to the suction inlet of the venturi apparatus at 30 kg/h. The mixed phase nozzle diameter (e.g., diameter of nozzle 60 in FIG. 3) was 1.6 mm. The venturi velocity was 5344 m/s within the continuous phase nozzle. The emulsion was stable with a median particle size of 0.8 microns.

While the present invention has been described with respect to particular embodiments thereof, it is apparent that numerous other forms and modifications will be obvious to those skilled in the art. The appended claims and this invention generally should be construed to cover all such obvious forms and modifications, which are within the true scope of the invention.

The invention claimed is:

1. A system for emulsifying a dispersed phase in a continuous phase having a venturi apparatus (50) having a through axis with an input end and an exit end, the system comprising:

a first inlet (48) for introducing a continuous phase stream in a downstream direction through the venturi apparatus (50), said venturi apparatus (50) defining a channel (56) for receiving the continuous phase stream that has a first diameter smaller than the first inlet (48) and that terminates in a concave conical section (58) on the downstream side of the channel (56), a continuous phase nozzle (66) defining a nozzle through passage having a nozzle passage input aperture at a first axial distance from the input end, and an exterior conical surface, positioned downstream of the conical section (58), receiving the continuous phase stream, and a nozzle passage output aperture at a second axial distance from the input end, said venturi nozzle (80) defining an annular second input chamber disposed about the continuous phase nozzle (66), the annular second input chamber having a first annular second input chamber surface at a third axial distance from the input end, the third axial distance being greater than the first axial distance and less than the second axial distance, and said venturi nozzle (80) defining a second inlet (62) defining a distal passage that directs a dispersed phase into the annular second input chamber, said venturi nozzle (80) further defining a conical mixing chamber (80) defined about a portion of the continuous phase nozzle (66) exterior conical surface, that tapers in diameter, the first annular second input chamber surface defining an annular passage that fluidly couples the first annular second input chamber to the conical mixing chamber (80), the conical mixing chamber (80) is fluidly coupled to a mixed phase nozzle (60) and to a discharge diffuser, wherein an emulsion is formed between the continuous phase stream and dispersed phase in the mixing chamber (80) and the emulsion fed to the mixed phase nozzle (60) and to the discharge diffuser, wherein the ratio of the diameter of the nozzle passage output passage to the diameter of the continuous phase nozzle is greater than 1:1 and less than 4:1.

2. The system of claim 1, wherein the first inlet (48) is configured to accept a continuous phase stream is introduced into the venturi apparatus at a pressure of from about 10 bar to about 50 bar.

3. The system of claim 1, further comprising a pump (22) to pump the continuous phase into the venturi apparatus (50).

4. The system of claim 1, wherein the continuous phase nozzle is configured to accept a continuous phase stream has having a velocity in the range of about 10 to 100 m/s through the continuous phase nozzle.

5. The system of claim 1, wherein the channel is configured to receive a continuous phase stream which comprises water or an aqueous solution of starch or a polymersolution.

6. The system of claim 1, wherein the dispersed phase comprises one or more inverse emulsions.

7. The system according to claim 1, wherein the median particle size of the resulting emulsion droplet is less than about 2 microns.

8. The system according to claim 1, wherein the venturi apparatus is formed of two machined parts, wherein the first part comprises the first inlet, the channel, the conical section, and the continuous phase nozzle, and the second part comprises the second inlet, the conical mixing chamber, the mixed phase nozzle, and the diffuser.

9. The system according to claim 8, wherein the first part and the second part are threadably connected.

10. The system according to claim 1, wherein the second inlet is defines a suction inlet that tapers to a conical distal end that conical distal passage directs the dispersed phase material to into a passage tubing that leads to the mixing chamber (80).

11. A method for emulsifying a sizing agent for use in treating paper or paperboard that comprises introducing under a pressure of from about 10 bar to about 50 bar, a continuous phase at a velocity of about 10 to 100 m/s comprising water or an aqueous solution of starch or a polymer solution into the first inlet of the venturi apparatus (50) of the system of claim 1, and introducing a dispersed phase containing at least one sizing agent through the second inlet of the venturi apparatus to form an emulsion of the dispersed phase and the continuous phase in the mixing chamber (80).

12. The method of claim 11, wherein the dispersed phase comprises cellulose non-reactive paper sizing compounds or cellulose reactive paper sizing compounds, selected from the group consisting of alkenyl succinic anhydride (ASA), alkyl ketene dimer (AKO), ketene dimers, ketene multimers, organic epoxides containing 12 to 22 carbon atoms, acyl halides containing 12 to 22 carbon atoms, fatty acid anhydrides from fatty acids containing 12 to 22 carbon atoms, and organic isocyanates containing 12 to 22 carbon atoms.

13. The method of any of claim 11, wherein the dispersed phase further comprises one or more surfactants in an amount of from 0.1% to about 5% by weight of said dispersed phase.

14. The method of any of claim 11, wherein the emulsion has a concentration of dispersed phase in continuous phase of from 2 to 50 percent by weight.

15. The method of claim 11, further comprising post-diluting the emulsion and adding the post-diluted emulsion either to a wet end or to a size press or coater for a paper or paperboard making system.

16. The system according to claim 11, wherein the median particle size of the resulting emulsion droplet is less than about 2 microns.

17. A method for reversing an inverse emulsion that comprises:

introducing under a pressure of from about 10 bar to about 50 bar, a continuous phase containing water into the first inlet of the venturi apparatus (50) of the system of claim 1; and introducing a dispersed phase containing at least one inverse emulsion through the second inlet of the venturi apparatus of the system of claim 1.

18. The method of claim 17, wherein the inverse emulsion comprises one or more retention and drainage aids for use in paper or paperboard making systems.

* * * * *